US010033133B2

(12) United States Patent
Zorlu et al.

(10) Patent No.: US 10,033,133 B2
(45) Date of Patent: Jul. 24, 2018

(54) WIRING HARNESS PLUG CONNECTOR

(71) Applicant: Robert Bosch GmbH, Stuttgart (DE)

(72) Inventors: Koeksal Zorlu, Markgroeningen (DE); Ulrich Schmatz, Besigheim (DE); Wolfgang Pade, Illingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/626,315

(22) Filed: Jun. 19, 2017

(65) Prior Publication Data

US 2017/0373428 A1 Dec. 28, 2017

(30) Foreign Application Priority Data

Jun. 24, 2016 (DE) ..... 10 2016 211 372

(51) Int. Cl.

| | |
|---|---|
| ***H01R 13/52*** | (2006.01) |
| ***H01R 13/422*** | (2006.01) |
| ***H01R 43/00*** | (2006.01) |
| ***H01R 43/20*** | (2006.01) |
| ***H01R 13/436*** | (2006.01) |

(52) U.S. Cl.

CPC ..... *H01R 13/5221* (2013.01); *H01R 13/422* (2013.01); *H01R 13/4361* (2013.01); *H01R 13/521* (2013.01); *H01R 13/5205* (2013.01); *H01R 13/5216* (2013.01); *H01R 43/005* (2013.01); *H01R 43/20* (2013.01)

(58) Field of Classification Search

CPC ..... H01R 13/5221; H01R 13/5216

See application file for complete search history.

(56) References Cited

U.S. PATENT DOCUMENTS

| | | | | |
|---|---|---|---|---|
| 5,518,427 | A | 5/1996 | Kan et al. | |
| 5,775,957 | A * | 7/1998 | Fink | H01R 13/4361 439/595 |
| 6,500,027 | B1 * | 12/2002 | Van Der Sanden | H01R 13/5216 439/587 |
| 7,722,396 | B2 | 5/2010 | Suzuki et al. | |
| 7,744,411 | B2 * | 6/2010 | Casses | H01R 13/465 439/275 |

(Continued)

FOREIGN PATENT DOCUMENTS

| | | | |
|---|---|---|---|
| DE | 19513914 | A1 | 10/1995 |
| DE | 69316453 | T2 | 6/1998 |

(Continued)

*Primary Examiner* — James Harvey

(74) *Attorney, Agent, or Firm* — Norton Rose Fulbright US LLP; Gerard Messina

(57) ABSTRACT

A wiring harness plug connector. The wiring harness plug connector encompasses a contact carrier and at least one electrical lead. The contact carrier has at least one passthrough conduit for the at least one electrical lead. The at least one electrical lead is passed through the passthrough conduit in an insertion direction. The contact carrier has, in front of the at least one passthrough conduit when viewed in the insertion direction, a partition that surrounds a sealing space. Provision is made that the sealing space is filled with a sealant in such a way, and that the sealant at least locally fills up the at least one passthrough conduit in such a way, that the at least one electrical lead is surrounded in fluid-tight fashion.

14 Claims, 6 Drawing Sheets

(56) References Cited

U.S. PATENT DOCUMENTS

| | | | | |
|---|---|---|---|---|
| 2004/0235347 | A1* | 11/2004 | Fukuda | H01R 13/5205 439/587 |
| 2009/0124123 | A1 | 5/2009 | Takahashi | |
| 2014/0106589 | A1* | 4/2014 | Genta | H01R 13/5208 439/283 |
| 2015/0171543 | A1* | 6/2015 | Sittner | H01R 13/405 439/271 |
| 2017/0373428 | A1* | 12/2017 | Zorlu | H01R 13/521 |

FOREIGN PATENT DOCUMENTS

| | | | |
|---|---|---|---|
| DE | 102004025087 | A1 | 12/2004 |
| DE | 202012004919 | U1 | 6/2012 |
| DE | 102011080347 | A1 | 2/2013 |
| DE | 102012212430 | A1 | 2/2014 |
| EP | 1610423 | A1 | 12/2005 |

* cited by examiner

WIRING HARNESS PLUG CONNECTOR

CROSS REFERENCE

The present application claims the benefit under 35 U.S.C. § 119 of German Patent Application No. DE 102016211372.0 filed on Jun. 24, 2016, which is expressly incorporated herein by reference in its entirety.

FIELD

The present invention relates to a wiring harness plug connector and to a method for manufacturing a wiring harness plug connector. The present invention furthermore relates to an auxiliary element for a wiring harness plug connector.

BACKGROUND INFORMATION

Electrical plug connector systems in which electrical contacts or contact elements are installed, together with the electrical leads disposed thereon, in a wiring harness plug connector, are known from the existing art. Often the contact element having the electrical lead crimped thereonto is guided into a preinstalled wiring harness plug connector. In order to enable sealing of the electrical contacts or contact elements and of the electrical leads with respect to fluid media (gases or liquids) from an external environment of the wiring harness connector, the electrical lead is often passed through a mat-type seal before the electrical contact element, together with its electrical lead fastened thereon, is introduced into the contact carrier. In another embodiment the seal can be brought about by the fact that the electrical contact or contact element is embodied using a so-called single-wire seal. A single-wire seal of this kind can be disposed, for example, at the crimp connection between the electrical contact element and the electrical lead, and then seals the electrical contact element in the contact carrier with respect to the external environment of the wiring harness plug connector.

A wiring harness plug connector having a mat-type seal is described in German Patent Application NO. DE 10 2011 080 347 A1.

SUMMARY

The present invention proceeds from the realization that conventional sealing by way of a mat-type seal or by way of a single-wire seal is cost-intensive, and is laborious in the context of production of the wiring harness plug connector and population thereof with the electrical leads and the electrical contacts installed thereon. A need can therefore exist to furnish a wiring harness plug connector in which the electrical contacts or contact elements, and at least locally also the electrical leads, are sealed with respect to fluid media from the external environment of the wiring harness plug connector in such a way that a mat-type seal and/or a single-wire seal in the conventional sense can be omitted. At the same time, the seal of the wiring harness plug connector is to be configured in such a way that it can maintain its sealing function over the service life of the wiring harness plug connector.

This need can be met by embodiments of the present invention. Advantageous embodiments of the present invention are described herein.

According to a first aspect of the present invention, a wiring harness plug connector that encompasses or has a contact carrier and at least one electrical lead is proposed. The contact carrier has at least one passthrough conduit for the at least one electrical lead. The at least one electrical lead is passed through the passthrough conduit in an insertion direction. The contact carrier has, in front of the at least one passthrough conduit when viewed in the insertion direction, a partition that surrounds a sealing space. Provision is made that the sealing space is filled with a sealant in such a way, and that the sealant at least locally fills up the at least one passthrough conduit in such a way, that the at least one electrical lead is surrounded in fluid-tight fashion.

In other words, the sealant extends inside the sealing space and at least locally into the at least one passthrough conduit and peripherally surrounds the at least one electrical lead, and seals, with respect to the external environment of the wiring harness plug connector, portions of the electrical lead located downstream.

The partition of the contact carrier can be embodied in peripherally continuous fashion. The upper side, surrounded by the partition, of the contact carrier can have, together with the partition, a cup-like conformation. The passthrough conduits then, for example, begin at the bottom of that cup-shaped conformation.

The contact carrier can have, for example, a plurality of passthrough conduits each for at least one electrical lead. Preferably the partition surrounds the majority of, or even all, the passthrough conduits for electrical leads in the contact carrier.

The contact carrier can be embodied in one piece. Provision can also be made, however, that the contact carrier is assembled from two initially separate contact carrier elements. For example, the contact carrier can have an upper contact carrier part and a lower contact carrier part. The at least one passthrough conduit can pass through one of the two parts, or both parts.

The at least one electrical lead can pass, viewed in the insertion direction, firstly through the sealing space having the sealant introduced thereinto, and then through the passthrough conduit.

The sealant and the sealing space can be coordinated with one another in terms of their materials and surfaces in such a way that the sealant can be intermaterially connected to the sealing space, i.e., to the upper side of the contact carrier and of the partition.

Alternatively or additionally, the passthrough conduit can interact, in terms of its material or its surface condition, with the material of the sealant in such a way that the passthrough conduit and the sealant are intermaterially connected to one another.

Alternatively or additionally, provision can be made that the sealant in terms of its material, and the electrical lead in terms of its surface condition and/or its material, are coordinated with one another in such a way that the sealant and the electrical lead are intermaterially connected to one another.

The advantageous result of the fact that the sealing space is filled with the sealant in such a way, and that the sealant at least locally fills up the at least one passthrough conduit in such a way, that the at least one electrical lead is surrounded in fluid-tight fashion, is that a particularly long-lasting and stable and fluid-tight seal between the external environment of the wiring harness plug connector and that part of the electrical lead which is disposed behind the sealant when viewed in the insertion direction, is brought about. Because the sealant is disposed not only in the sealing space but also at least locally in at least one passthrough conduit, the sealing effect is particularly advantageously enhanced as compared with conventional assemblages that have only a mat-type seal. If an, or the at least one, electrical lead is therefore located in the passthrough conduit, that lead is then sealed in the passthrough conduit itself. As compared with conventional embodiments that have only a single-wire seal, the sealant provided in the sealing space brings about an enhancement of the sealing effect, since leakage in a single passthrough conduit is compensated for by the sealing effect in the sealing space. The seal is thus, advantageously, embodied redundantly. The longevity of the sealing effect is furthermore thereby enhanced. The proposed seal can moreover be manufactured particularly inexpensively and simply.

The sealant can also reliably and effectively seal passthrough conduits that are not populated with an electrical lead.

Preferably the sealing space is contiguous with an external environment of the wiring harness plug connector. The advantageous result thereof is that fluid media that are present in the external environment of the wiring harness plug connector (for example, exhaust gas, splashed water, corrosive media, etc.) are already kept a particularly long distance away from sensitive components of the wiring harness plug connector by the seal. In other words, fluid media are prevented from penetrating at all from the external environment of the wiring harness plug connector into the wiring harness plug connector.

Provision can be made that the sealant is constituted from a material that is liquid in a first state and can be converted into a second, non-fluid state in such a way that in the second state it can no longer flow into the at least one passthrough conduit. The second state can be permanent, i.e. the transition from the first into the second state can be an irreversible one, for example as a result of polymerization or another chemical reaction. In other words, the material can be constituted in such a way that upon introduction into the sealing space it is liquid (first state), and after introduction it cures or becomes cured (second state) in such a way that in the cured state it can no longer flow into the at least one passthrough conduit. The selection of such a sealant results in particularly simple manufacture of the wiring harness plug connector and of the seal of the at least one electrical lead. In addition, because the sealant exists in a liquid form (first state) upon introduction of the sealant into the sealing space, the sealant can also penetrate particularly easily, at least locally, into the at least one passthrough conduit. An electrical lead disposed in that passthrough conduit can thus be surrounded in simple fashion and can reliably become sealed or be sealed after curing (e.g. an irreversible conversion into the second state). After curing, the sealant is dimensionally stable and produces reliable sealing of the at least one electrical lead. The conversion into the second state can be achieved, for example, by way of a temporary temperature elevation or by adding a second material component that produces a chemical reaction.

Provision can be made that the sealant is constituted from an elastomer. The sealant can encompass, in particular, silicone. The advantageous result thereof is that the at least one electrical lead is reliably and securely protected from the penetration of fluid media from the external environment of the wiring harness plug connector. Particularly advantageously, in this manner the sealant can be introduced or injected into the sealing space and into the at least one passthrough conduit after the at least one electrical lead has been introduced into the passthrough conduit. That introduction can occur when the sealing agent or sealant is in a liquid state. The sealant can then be cured.

A refinement provides that the wiring harness plug connector furthermore encompasses a locking element. The locking element is slidable into the wiring harness plug connector transversely to the insertion direction. The wiring harness plug connector can have for this purpose, for example on its contact carrier, a slide-in opening or an opening through which the locking element is slidable into the wiring harness plug connector. The locking element is embodied in such a way that in the slid-in state it prevents a contact element, connected to the at least one electrical lead, from being removed from the contact carrier oppositely to the insertion direction. The locking element has for that purpose a base element and at least two self-supporting arms spaced apart from one another and protruding transversely from the base element. The at least two arms each have at least one sealing lip. The sealing lips of adjacent arms face toward one another and are configured in such a way that an interstice between the adjacent arms is at least 80% closed. An interstice between the adjacent arms is preferably at least 90% closed. The sealing lips can also be embodied in such a way that they overlap and/or cover or close off the interstice 100%, i.e., completely.

If the locking element or an auxiliary element has more than two arms on the base element, individual arms can then also be embodied without a sealing lip, but two arms at least each have at least one sealing lip. Provision can also be made, however, that each arm has at least one sealing lip.

In other words, the locking element can have, for example, a comb-like structure, the base element representing the comb shaft and the at least two self-supporting arms spaced apart from one another and protruding transversely from the base element being embodied in the manner of comb teeth.

The locking element can be embodied in the manner of a secondary locking element. This is to be understood to mean that a contact element disposed, for example, on the at least one electrical lead can have, for example, a latching tip with which it can interact in the contact carrier, or in a receiving chamber of the contact carrier, in such a way that it is secured against removal from the contact carrier after the insertion operation. The contact element is thus latched in the contact carrier by way of a latching tip of this kind. It can be desirable to prevent the contact element from being capable of being torn out of the receiving chamber of the contact carrier upon a stronger pull, for example, on the electrical lead, in which context the latching tip, for example, breaks off. The locking element can be provided for that purpose. It can be embodied, for example, in such a way that after insertion through the opening, the contact elements lock in the contact carrier by way of a positive connection, in addition to the latching as a result of the latching tips. Thanks to the locking element in its interaction with the at least one contact element, substantially larger forces can be exerted on the contact element, or on the electrical lead fastened thereto, before the contact element can be removed from the contact carrier oppositely to the insertion direction.

The advantageous result of the fact that the locking element and the at least two arms protruding therefrom each have at least one sealing lip, the sealing lips of adjacent arms facing toward one another and being configured in such a way that an interstice between the adjacent arms is at least 80%, in particular at least 90% closed, is that after population of the contact carrier with the electrical leads or with the at least one electrical lead, the sealant can be filled with a liquid or relatively low-viscosity sealant (first state of the sealant). That sealant can then fill up the sealing space and flow into the passthrough conduits or into the at least one passthrough conduit. The sealing agent is prevented, by the sealing lips of the mutually facing adjacent arms, from penetrating into the passthrough conduit beyond the locking element or downstream from the locking element.

When the locking element is in the inserted state, the sealing lips surround the at least one electrical lead and thus seal off the passthrough conduit. If one of the passthrough conduits is not populated with an electrical lead, then upon complete sealing or complete covering of the interstice between adjacent arms by the sealing lips, such a passthrough conduit can also be filled up with sealing agent or sealant even though portions or parts of the passthrough conduit or of the contact carrier disposed downstream from the locking element are not filled up with sealant. This is to be understood to mean that after filling of the sealing space and of the at least one passthrough conduit with the sealant, and after curing (second state of the sealant) of the sealant, the locking element can remain inserted in the wiring harness plug connector as a locking element or as a secondary locking element. After filling, the sealant can, for example, be cured or converted into the second state, so that in principle the locking element can be removed after curing of the sealant without allowing the sealant to penetrate into regions of the passthrough conduit which are disposed downstream from the locking element.

With the aid of the locking element configured in this manner, in interaction with the wiring harness plug connector, it is possible to ensure, in particularly simple and reliable fashion, highly efficient and inexpensively producible sealing of the wiring harness plug connector with respect to penetration of fluid media from the external space or external environment of the wiring harness plug connector into regions of the contact carrier which are located downstream from the locking element.

The base element and the at least two self-supporting arms spaced apart from one another and protruding transversely from the base element can be embodied from a first material. This first material can be, for example, a relative hard or stiff material that exhibits little elasticity. It can encompass, for example, polyamide; glass-reinforced plastics (GRPs) are also possible, for example PA66 GF35. The at least one sealing lip that is disposed on the at least two arms can be embodied from a second material that exhibits substantially greater elasticity or flexibility as compared with the first material of the at least two arms. The second material is thus substantially less stiff than the first material and can conform flexibly to contours, for example to the at least one electrical lead. The at least one sealing lip can encompass or be constituted from, for example, rubber or silicone (e.g., single-component silicone or two-component silicone or silicone rubber, etc.), or another flexible elastomer, as a second material.

The at least one sealing lip can, for example, be injection-molded onto the associated arm.

The locking element can also be embodied, for example, as an auxiliary element.

Provision can be made that the at least one sealing lip of an arm has a profile along its self-supporting end that faces away from the arm. The profile can be embodied complementarily to the outer contour of the at least one electrical lead that is surrounded by the sealing lip when the locking element is in the inserted state. The advantageous result thereof is that particularly reliable sealing is ensured upon insertion of the locking element transversely to the insertion direction. The reason is that this reduces the risk of the sealing lip becoming displaced out of the plane of the sealing lip, in the insertion direction or oppositely to the insertion direction, in the region of the at least one electrical lead, so that a slight leak might thereby occur between the at least one electrical lead and the sealing lip.

Provision can be made that the at least one sealing lip of an arm is fastened on the arm displaceably, transversely to the extension direction of the arm, with respect to the associated arm. In other words, in a first position the at least one sealing lip can be disposed, for example, inside the at least one arm or below the at least one arm. In a second position it is shiftable or displaceable; that second position can be characterized in that the at least one sealing lip is displaced out of the at least one arm toward the adjacent arm or toward the interstice between adjacent arms, and thus closes that interstice. If the at least one sealing lip happens to be disposed below or above the at least one arm (viewed in terms of the insertion direction), it can thus be displaced respectively below or above that arm into the interstice. In order to enable the displacement, the sealing lip can be mounted displaceably on or in the relevant arm, for example in or with a guidance element. It can be shiftable, for example, in a gate.

The advantage achieved with this refinement is that upon insertion or sliding in of the locking element or auxiliary element, the sliding-in operation can be carried out particularly simply. That is, the insertion force is low. Once the insertion operation or sliding-in operation is complete, the displacement of the at least one sealing lip of the corresponding arm toward the interstice can then be caused. The interstice between adjacent arms is thereby closed. The sliding-in and sealing operation is thus divided by the locking element into two mutually independent steps: firstly the step of inserting the locking element, then followed by the step of displacing the sealing lip toward the interstice. The actual sealing of the passthrough conduit and of the at least one electrical lead with respect to the initially liquid sealant is thereby brought about. A further advantage of this twofold division of the sealing process is that in the context of the sliding-in operation, in particular in the case of a four-pole wiring harness plug connector, the sealing lip does not initially need to be slid with its free end along the at least one electrical lead or along a plurality of electrical leads, thereby being exposed to the risk of damage to the outermost edge of the sealing lip. It is only after completion of the operation of inserting the locking element that the sealing lip is pushed or displaced toward the interstice into its final sealing position, i.e. the second position, and can thus produce the seal in undamaged fashion.

According to a second aspect of the invention, a method for manufacturing a fluid-tight wiring harness plug connector is proposed. The wiring harness plug connector has a contact carrier, the contact carrier having at least one passthrough conduit for passage of at least one electrical lead. The contact carrier has, in front of the at least one passthrough conduit when viewed in an insertion direction, a partition that surrounds a sealing space. The example method according to the present invention encompasses the following steps or has the following steps:

- furnishing the contact carrier;
- introducing at least one electrical lead, in the insertion direction, through the sealing space and through the at least passthrough conduit;
- introducing an auxiliary element into the wiring harness plug connector, the auxiliary element sealing the at least one passthrough conduit at least locally in such a way that penetration of a liquid sealant from the passthrough conduit into portions downstream from the auxiliary element is prevented;

introducing a liquid sealant into the sealing space;

curing the sealant.

The proposed method prevents particularly simple, inexpensive, and reliable sealing of the wiring harness plug connector with respect to penetration of fluid media (gases or liquids) from an external environment into the interior of the wiring harness plug connector. The sealing effect is particularly good because the sealant penetrates both into the sealing space and into the passthrough conduits or at least one passthrough conduit disposed downstream from the sealing space. This method thus combines the advantages of a mat-type seal with the advantages of a single-wire seal. On the one hand the sealant is provided in the sealing space; on the other hand, the sealant is present at least locally in the at least one passthrough conduit and thus seals off the at least one electrical lead in the at least one sealing conduit or passthrough conduit. Even in the event an electrical lead happens not to be provided in one of the passthrough conduits, that passthrough conduit is at least locally filled up by the sealant and is correspondingly sealed with respect to the penetration of fluid media from the external environment of the wiring harness plug connector. Thanks to the introduction of the sealant in a liquid or low-viscosity form, the sealant can be distributed evenly in the sealing space and in the at least one passthrough conduit. The result of subsequent curing is that even with the plug connector positioned differently (for example, "upside down"), the sealing agent can no longer flow out of the sealing space. Further penetration into the passthrough conduits after curing is also precluded.

The sealant on the one hand, and the partition of the sealing space, can be embodied in such a way that an intermaterial connection occurs between the sealant and partition.

Alternatively or additionally, the sealant on the one hand, and the at least one passthrough conduit or at least one electrical lead on the other hand, can be embodied in such a way that an intermaterial connection occurs between the sealant and the at least one passthrough conduit or between the sealant and the at least one electrical lead. The sealing effect is thereby enhanced in particularly advantageous fashion.

Provision can be made in this context that the auxiliary element has a base element and at least two self-supporting arms spaced apart from one another and protruding transversely from the base element. The at least two arms can each have at least one sealing lip, the sealing lips of adjacent arms facing toward one another and being configured in such a way that an interstice between the adjacent arms is at least 80% closed. Particularly preferably, an interstice between the adjacent arms is at least 90% closed, or even completely closed. Provision can be made that mutually facing sealing lips of adjacent arms in fact overlap. The advantageous result thereof is that a kind of temporary or permanent sealing of the passthrough conduits or of the at least one passthrough conduit is brought about by way of the auxiliary element that is introduced or slid, or introducible or slidable, into the contact carrier transversely to the insertion direction. The sealant can thus, upon introduction thereof into the sealing space and into the passthrough conduits adjacent to the sealing space, penetrate downstream from the sealing space only as far as the sealing lips of the auxiliary element. Those portions of the at least one passthrough conduit disposed downstream from the auxiliary element in which, for example, a contact element connected to the at least one electrical lead is disposed in a receiving chamber of the contact carrier are thus not filled up by the sealing agent or sealant. For example, the auxiliary element can be put in place for sealing of the liquid sealant until the liquid sealant has cured (second state of the sealant). After curing of the sealant the auxiliary element can also, for example, be removed again from the contact carrier or from the wiring harness plug connector, since the sealant cannot penetrate further into the passthrough conduits, or into the at least one passthrough conduit, once the sealant has cured.

Provision can be made that the auxiliary element is removed from the wiring harness plug connector after the step of curing the sealant. In a step subsequent thereto, a locking element can be inserted into the wiring harness plug connector. The locking element can be embodied in such a way that in the slid-in state it prevents the removal, oppositely to the insertion direction, of a contact element connected to the at least one electrical lead. Thanks to this refinement, the function of sealing the at least one passthrough conduit until the sealant has cured is separated from the function of the locking element, with which a contact element, for example fastened to the at least one electrical lead, is prevented from moving out of the contact carrier oppositely to the insertion direction. In this fashion, for example, the auxiliary element and the locking element can be manufactured from different materials. For example, the auxiliary element can be repeatedly reused and can thus encompass higher-quality materials (e.g., of the sealing lips) or can be specifically designed for the sealing function upon introduction and curing of the sealant. The locking element can then be designed specifically for the task or function of locking the electrical leads disposed in the wiring harness plug connector and the contact elements fastened thereto.

In a refinement, provision can be made that the auxiliary element acts as a locking element and is embodied in such a way that in the slid-in state it prevents the removal, oppositely to the insertion direction, of a contact element connected to the at least one electrical lead. In other words, the auxiliary element can be embodied in such a way that it also takes on the function of the locking element. In this case the auxiliary element is embodied as a locking element and has, additionally as compared with conventional locking elements, sealing lips that close off in large part the interstice between adjacent arms of the auxiliary element or locking element.

The result of this configuration is that a fluid-tight wiring harness plug connector can be created in particularly cost-saving fashion. After insertion of the auxiliary element, which simultaneously acts as a locking element, the liquid sealant is fed into the sealing space and can also flow into the at least one passthrough conduit until its penetration in the at least one passthrough conduit is prevented by the auxiliary element and the sealing lips disposed thereon. The sealant is then cured. Removal of the auxiliary element is then no longer necessary, since the auxiliary element is already acting as a locking element. Working steps can thereby be eliminated. The auxiliary element remains in the wiring harness plug connector and now acts as a locking element or secondary lock.

According to a third aspect of the present invention, an auxiliary element for insertion into a wiring harness plug connector is provided. The auxiliary element can preferably be suitable for preventing the removal of a contact element that is connected to an electrical lead and is slid into the wiring harness plug connector. The auxiliary element has a base element and at least two self-supporting arms spaced apart from one another and protruding transversely from the base element. The at least two arms each have at least one sealing lip. The sealing lips of adjacent arms face toward one another and are configured in such a way that an interstice between adjacent arms is at least 80% closed. Particularly preferably, an interstice between adjacent arms is at least 90% closed; very particularly preferably, an interstice between adjacent arms is completely closed.

The auxiliary element can simultaneously be embodied as a locking element.

Particularly simple and inexpensive sealing of a wiring harness plug connector can be produced by providing the at least one sealing lip between the at least two arms, since the auxiliary element can seal a passthrough conduit, provided in the wiring harness plug connector, in such a way that a liquid sealant can be fed into the wiring harness plug connector (first state of the sealant) and cured there (second state of the sealant). The wiring harness plug connector can thereby be embodied in fluid-tight fashion, so that penetration of fluid media from an external environment of the wiring harness plug connector into passthrough conduits disposed in the interior of the wiring harness plug connector, or into contact elements disposed therein, is prevented. By way of its sealing lips the auxiliary element permits sealing of the passthrough conduits, or of at least one passthrough conduit, in the wiring harness plug connector with respect to penetration of the liquid sealant while such liquid sealant is not yet cured.

In the context of the Application, the wiring harness plug connector can have not only one passthrough conduit but also a plurality of passthrough conduits. It is similarly to be understood that the passthrough conduits can have different diameters or cross sections. Provision can be made that individual passthrough conduits, or at least one passthrough conduit, are/is not populated with an electrical contact or electrical lead.

BRIEF DESCRIPTION OF THE DRAWINGS

Further features and advantages of the present invention are described below with reference to exemplifying embodiments and the figures, and that are nevertheless not to be construed as limiting the present invention.

DETAILED DESCRIPTION OF EXAMPLE EMBODIMENTS

Figure 1A:
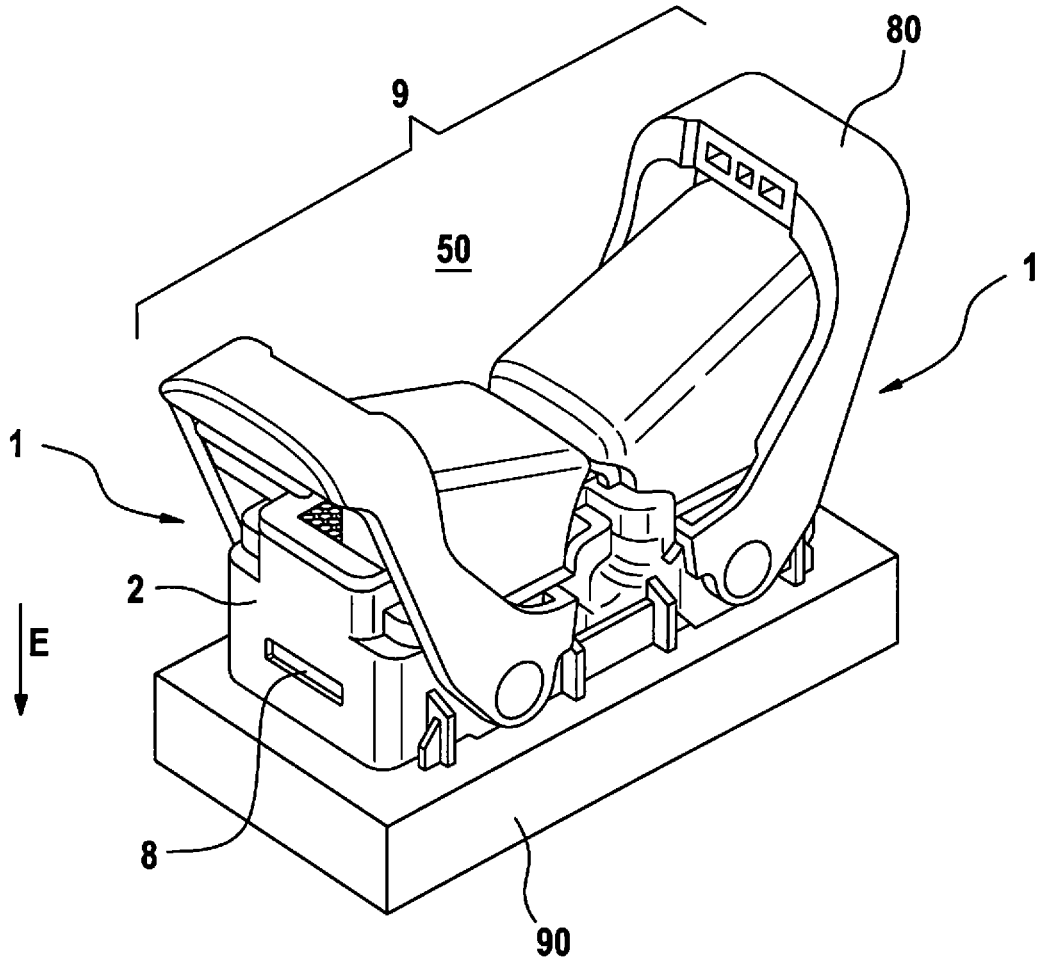
FIG. 1*a* is a perspective view of a wiring harness plug connector.

FIG. 1*a* shows a plug connector system 9 that encompasses two wiring harness plug connectors 1 and a multipoint connector 90. The two wiring harness plug connectors 1 can be embodied physically identically as depicted in the exemplifying embodiment. In the assembled system they are placed onto multipoint connector 90 and locked to the multipoint connector. Wiring harness plug connectors 1 depicted by way of example each have a contact carrier 2 in whose wall is embodied an opening 8 for introducing or sliding in a locking element 30 or auxiliary element 10 transversely to an insertion direction E for electrical leads 4 (FIGS. 2 to 5). Wiring harness plug connectors 1 can each have a lever element 80 with which insertion of wiring harness plug connectors 1 onto multipoint connector 90 can be carried out with less energy expenditure.

Figure 1B:
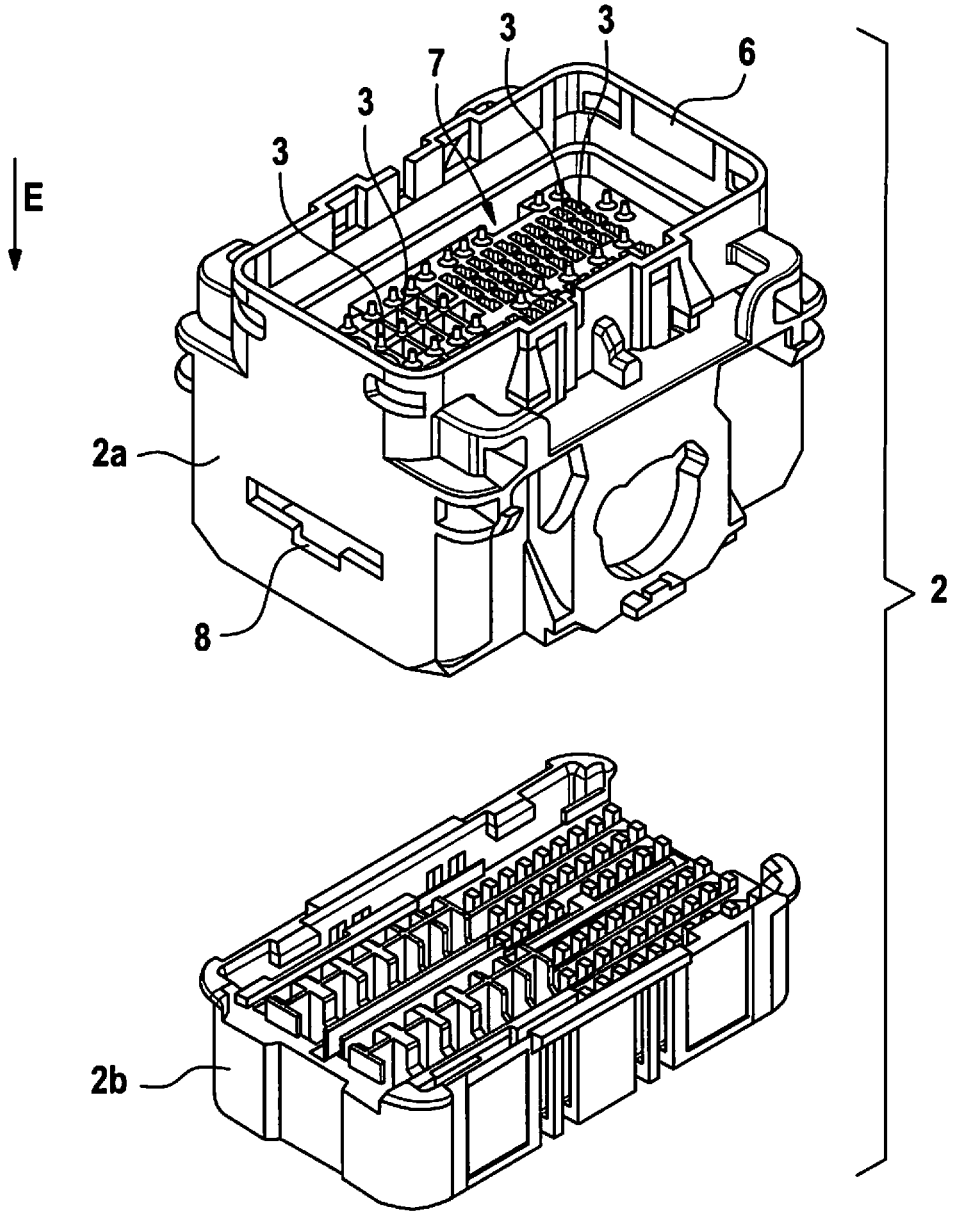
FIG. 1*b* is a perspective view of a contact carrier of a wiring harness plug connector.

FIG. 1*b* shows a contact carrier 2 of wiring harness plug connector 1. In the exemplifying embodiment depicted, contact carrier 2 is embodied in two parts and encompasses an upper contact carrier part 2*a* as well as a lower contact carrier part 2*b* connectable to upper contact carrier part 2*a*. In alternative embodiments, contact carrier 2 can also be embodied as a single part. In the exemplifying embodiment depicted, upper contact carrier part 2*a* has a plurality of passthrough conduits 4 through which electrical leads 4 (FIG. 2) can be passed through in insertion direction E. Typically, at least one electrical lead 4 can be passed through into each passthrough conduit. In the exemplifying embodiment depicted, lower contact carrier part 2*b* has an associated receiving chamber (no reference character) for each passthrough conduit 3. A respective contact element 40 can be received in each of these receiving chambers and latched therein. Typically, each contact element 40 is mechanically and electrically connected to one electrical lead 4.

In order to prevent withdrawal of contact elements 40 from the receiving chambers of lower contact carrier part 2*b* in addition to the latching effect, a locking element 30 can, for example, be slid transversely to insertion direction E into opening 8 of upper contact carrier part 2*a*. The latching or primary latching of the at least one contact element 40 can be brought about, for example, by way of at least one latching tip 41 on contact element 40, and an undercut on lower contact carrier part 2*b*.

In order to achieve locking between the receiving chamber and passthrough conduit 4 of contact carrier 2, viewed in the insertion direction, locking element 30 can be slid in or introduced or inserted in such a way that contact element 40 is positively prevented from moving out of contact carrier 2 oppositely from insertion direction E. Parts of the locking element can project at least partly into passthrough conduits 4, viewed transversely to insertion direction E, and thereby prevent contact elements 40 from moving out.

Contact carrier 2 (upper contact carrier part 2*a* in the exemplifying embodiment depicted) has on its frontmost portion in terms of insertion direction E (at the top in the Figure) a partition 6 that completely surrounds passthrough conduits 4. The partition is closed in fluid-tight fashion. The partition thus surrounds a sealing space 7. Sealing space 7 has a floor that is perforated by passthrough conduits 4.

Without the openings of passthrough conduits 4, sealing space 7 along with partition would be closed off in cup-shaped fashion.

Figure 2:
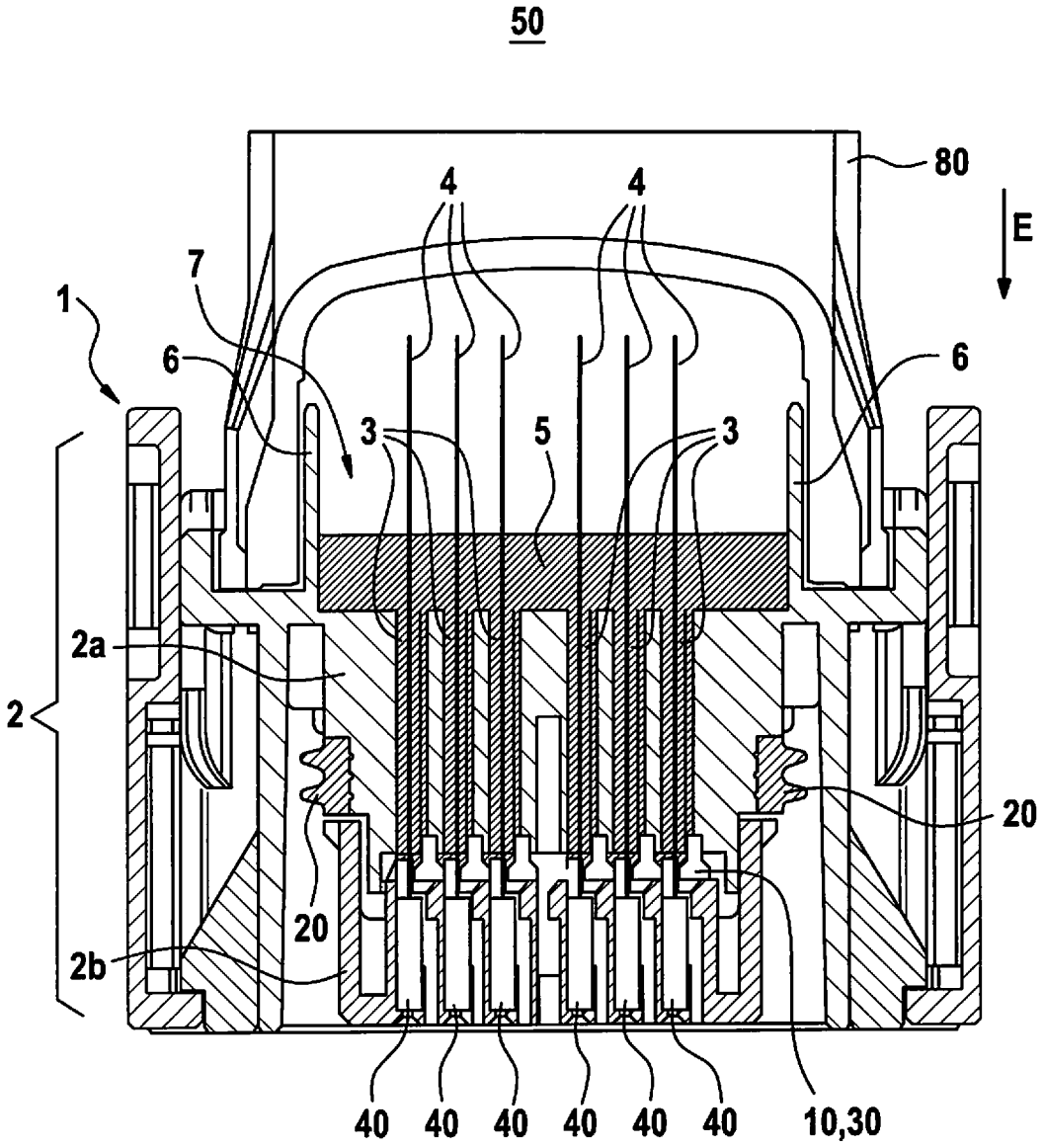
FIG. 2 is a cross section through a wiring harness plug connector.

FIG. 2 is a cross section through contact carrier 2 of FIG. 1*b*, populated with electrical leads 4 and electrical contacts 40 or contact elements 40 fastened thereto. A sealant 5, for example an elastomer, e.g. silicone, is fed into sealing space 7. Sealant 5 extends out of sealing space 7, downward as viewed in FIG. 2, into passthrough conduits 3. Sealing agent 5 thus substantially completely surrounds electrical leads 4, and thus seals electrical leads 4 and contact elements 40 with respect to penetration of fluid media from external environment 50 of plug connector 1, not only in sealing space 7. It instead also surrounds electrical leads 4 in a fluid-tight manner, at least locally in passthrough conduits 3. The corresponding portion in passthrough conduits 3, in which sealant 5 extends, extends in insertion direction E, viewed from the floor of sealing space 7, as far as the plane in which opening 8, for introducing auxiliary element 10 or locking element 30, is disposed. As illustrated in FIG. 2, the sealant thus extends from auxiliary element 10 or locking element 30 into passthrough conduits 3, upward to the floor of sealing space 7. A very advantageous sealing effect is thereby produced by sealant 5; specifically, the positive properties of a sealing mat and of a single-wire seal are combined. The properties of a sealing mat are achieved by way of sealant 5 in sealing space 7. The properties of a single-wire seal are achieved by way of sealant 5 extending into passthrough conduits 3. It is understood that in the embodiment presented, passthrough conduits 3 in which an electrical lead 4 is not present can also be filled with sealant 5.

This highly efficient fluid-tight sealing of wiring harness plug connector 1 can be brought about as follows:

- firstly, in a first step, contact carrier 2 (here encompassing upper contact carrier part 2*a* and lower contact carrier part 2*b*) is furnished;
- in a further step, contact elements 40 and electrical leads 4 fastened thereonto are introduced into the receiving chambers through passthrough openings 3 of contact carrier 2 (in this case, through upper contact carrier part 2*a* and lower contact carrier part 2*b*). Contact elements 40 then latch into receiving chambers of contact carrier 2, for example by way of latching tips 41 fastened on contact elements 40;
- in a further step, either auxiliary element 10 or in fact locking element 30 is inserted into contact carrier 2, transversely to insertion direction E, through opening 8 of contact carrier 2. Auxiliary element 10 or locking element 30 is embodied in such a way that it seals off the upper (in the Figure) portions of passthrough conduits 3 (i.e. the portions located upstream) in fluid-tight fashion with respect to the receiving chambers or with respect to those portions of passthrough conduits 4 [sic; 3] which are located downstream from auxiliary element 10 or locking element 30;
- in a further step, a liquid sealant 5 (first state of the sealant), which e.g. contains an elastomer or can encompass silicone, is then fed into sealing space 7; the liquid sealant 5 is also distributed into those portions of passthrough conduits 3 which are located above auxiliary element 10 or locking element 30;
- in a further step, sealant 5 is cured (conversion into the second state of sealant 5) so that it can no longer flow. Curing can be brought about, for example, by a temporary temperature elevation or, for example, by contact with air or oxygen.

After this last step the seal has been produced. The seal is particularly effective if sealant 5 enters into in an intermaterial join with partition 6 and/or with electrical leads 4 and/or with the walls of passthrough conduits 3. Fluid media (gases or liquids) from external environment 50 of wiring harness plug connector 1 thus can no longer penetrate into the interior of wiring harness plug connector 1 (at the bottom in the illustration).

When an auxiliary element 10 is used, that auxiliary element 10 is removed from opening 8 after curing. A locking element 30 can then be used, instead of auxiliary element 10, in order to prevent contact elements 40 from moving out of the receiving chambers oppositely to insertion direction E. Alternatively, auxiliary element 10 can already be embodied as locking element 30 and can prevent contact elements 40 from moving out of contact carrier 2 oppositely to insertion direction E, for example by positive engagement with contact elements 40.

FIG. 2 furthermore depicts a radial seal 20, on the outer periphery of upper contact carrier part 2*a*, that can interact with a housing of multipoint connector 90 in such a way that fluid media also cannot penetrate from external environment 50 of wiring harness plug connector 1 laterally through plug connector system 9 into the interior of wiring harness plug connector 1.

Sealing space 7 is contiguous with an external environment of wiring harness plug connector 1.

It is to be understood that wiring harness plug connector 1 can also have, for example, only a single passthrough opening 3 for introduction of a single electrical lead 4 having a single contact element 40 mounted thereon.

Figure 3B:
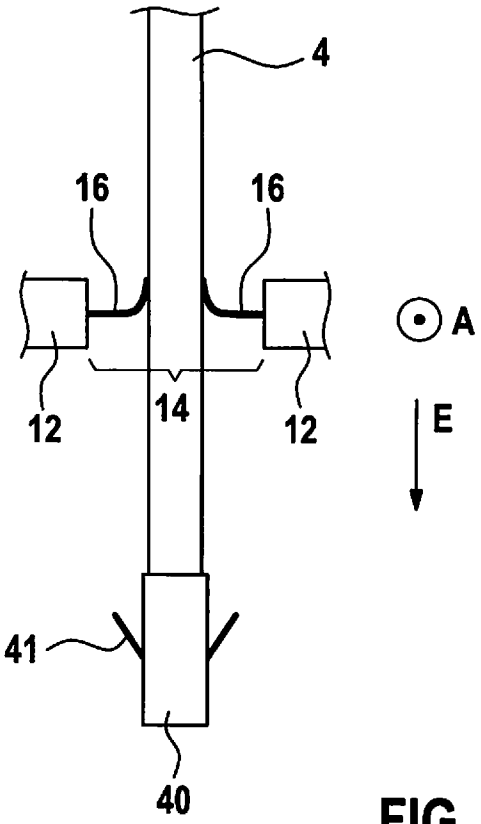
FIG. 3*b* is a cross section through a passthrough conduit and an auxiliary element or locking element according to FIG. 3*a*.
Figure 3A:
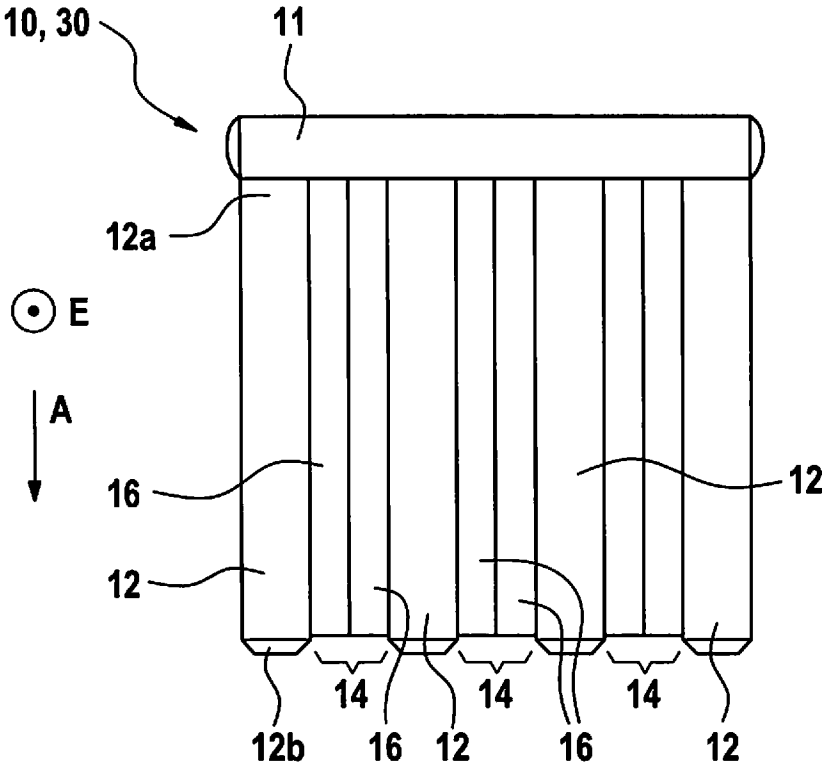
FIG. 3*a* is a plan view, from an insertion direction, of an auxiliary element or locking element, according to an embodiment.

FIG. 3*a* is a plan view, looking in insertion direction E, of an auxiliary element 10 or a locking element 30 in accordance with an embodiment of the invention. Insertion direction E is directed into the plane of the drawing. Auxiliary element 10 or locking element 30 encompasses a base element 11 and at least two self-supporting arms 12 spaced apart from one another and protruding transversely from the base element 11. In this exemplifying embodiment arms 12 protrude from base element 11 substantially vertically in an extension direction A. When locking element 30 is in the inserted state, extension direction A of arms 12 extends substantially perpendicularly to insertion direction E of contact elements 40 or of electrical leads 4. In the exemplifying embodiment depicted, a plurality of four arms 12 are disposed, by way of example, on base element 11. Auxiliary element 10 or locking element 30 thus has a comb-like structure, base element 11 representing the shaft of the comb and arms 12 the teeth of the comb. Arms 12 each have at least one sealing lip 16. Sealing lips 16 are disposed on arms 12 in such a way that sealing lips 16 of respectively adjacent arms 12 face toward one another and are configured in such a way that an interstice 14 between adjacent arms 12 is at least 80%, particularly preferably at least 90%, closed off. In the exemplifying embodiment depicted, sealing lips 16 of adjacent arms overlap in such a way that interstice 14 is completely closed off.

Base element 11 and arms 12 can be constituted, for example, from a first material that is relatively stiff or solid and cannot easily be deformed. For example, the first material can encompass polyamide (PA); it can also be glass fiber-reinforced (GFR), e.g. PA66 GF35. In contrast thereto, sealing lips 16 can be constituted from a soft, elastic second material that particularly effectively envelops or elastically surrounds electrical leads 4 passing through between sealing lips 16 and nevertheless produces a seal with respect to the liquid sealant 5. The second material can encompass, for example, rubber, silicone, silicone rubber, or other elastomers. The second material can encompass, for example, a two-component silicone. Sealing lips 16 can be injection-molded onto arms 12 or can be fastened onto arms by way of an adhesive join or welded join.

Electrical leads 4 can pass through into interstices 14. In other words, when auxiliary element 10 or locking element 30 is in the inserted state, the passthrough conduits can arrive at interstices 14 when viewed along the insertion direction.

FIG. 3*b* is a cross section through contact carrier 2, depicting an electrical lead 4 having a contact element 40 disposed thereon. Contact element 40 encompasses two latching tips 41 with which contact element 40 can latch into undercuts of contact carrier 2. Depicted farther up in the illustration (i.e. upstream from latching tips 41 viewed in insertion direction E) are two arms 12 of locking element 30 or of auxiliary element 10, and sealing lips 16 disposed thereon. Extension direction A now points into the plane of the drawing. Sealing lips 16 extend from arms 12, respectively inward toward electrical lead 4. Sealing lips 16 abut tightly against electrical lead 4; surround it, for example, elastically like a collar; and thus seal off the portion above sealing lips 16 in the illustration (upstream from sealing lips 16) with respect to a portion below sealing lips 16 in the illustration (downstream from sealing lips 16). The liquid sealant 5, for example, can thus be fed into the portion above sealing lips 16. Sealant 5 then cannot penetrate into the portion below sealing lips 16. Sealant 5 can thus be cured without penetrating into the portion disposed downstream from sealing lips 16 (toward the bottom in the Figure). Upon introduction of the liquid sealant 5, contact carrier 2 is preferably aligned as depicted in FIGS. 2 and 3*a*, i.e. gravity is acting downward in the Figures in insertion direction E.

Figure 4B:
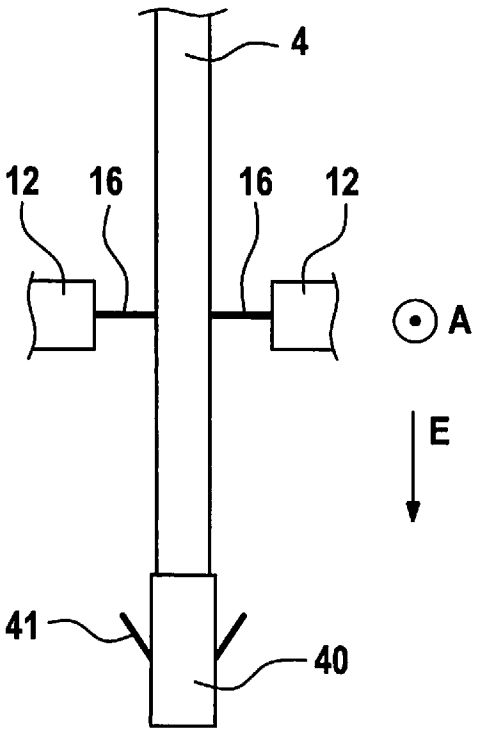
FIG. 4*b* is a cross section through a passthrough conduit and an auxiliary element or locking element according to FIG. 4*a*.
Figure 4A:
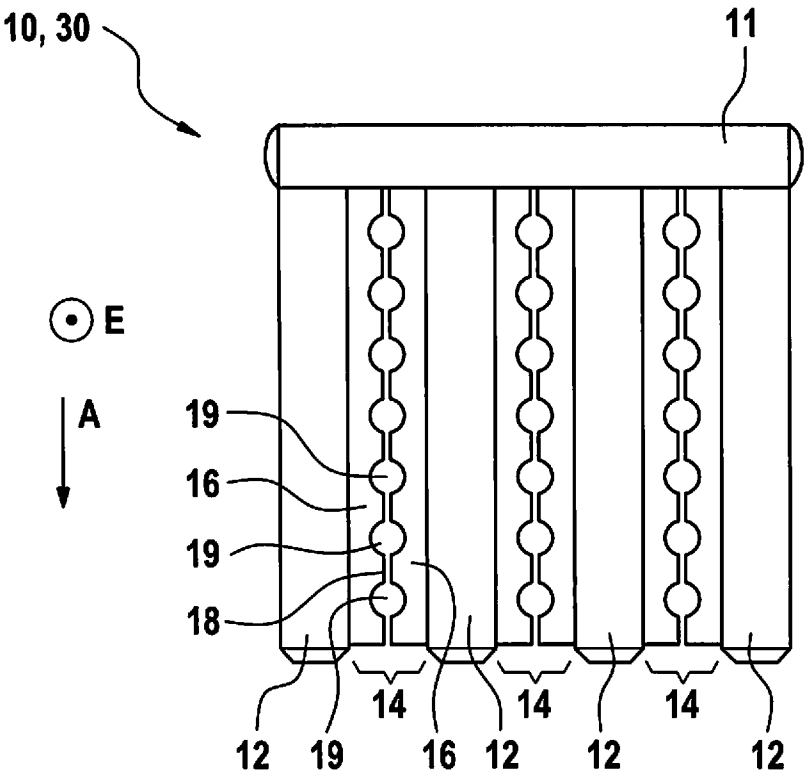
FIG. 4*a* is a plan view, from an insertion direction, of an auxiliary element or locking element, according to a further embodiment.

FIG. 4*a* shows a further embodiment of auxiliary element 10 or of locking element 30 in the same view as FIG. 3*a*; insertion direction E is thus directed into the plane of the drawing. In this exemplifying embodiment sealing lips 16 are embodied in such a way that their free ends 18 that project into interstice 14 do not overlap but instead abut against one another or at least approximately touch one another. In another embodiment, however, free ends 18 of sealing lips 16 can also overlap. Sealing lips 16 also have in particular on their free ends 18, however, a profiling 19 or profile such that a cutout 19 is provided for each passthrough conduit 3 or for each electrical lead 4. In other words, instead of a, for example, linear or straight conformation of free end 18 of the respective sealing lips 16, sealing lip 16 is recessed toward the relevant arm 12 at those points at which sealing lip 16 surrounds an electrical lead 4. Sealing lip 16 coming from the respective other side likewise exhibits a cutout or profile 19 of this kind. The result is that a particularly advantageous sealing effect can result when auxiliary element 10 or locking element 30 is slid into opening 8 of contact carrier 2. The reason is that at those points at which an electrical lead 4 is disposed, the respective mutually facing sealing lips 16 can now tightly surround electrical lead 4 without being offset in insertion direction E or oppositely to insertion direction E.

FIG. 4*b* is a view like FIG. 3*b*, i.e. extension direction A of arms 12 is directed into the plane of the drawing. It is evident that sealing lips 16 surround the respective electrical lead 4 like a tight-fitting, for example elastic, collar. The sealing effect can thereby advantageously be improved.

Figure 5B:
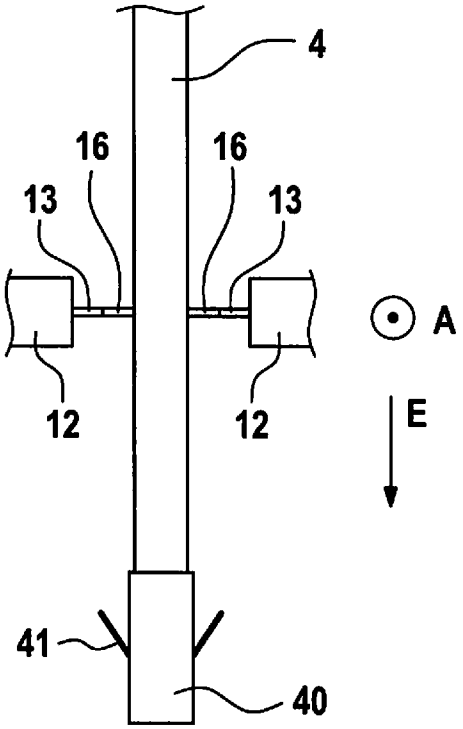
FIG. 5*b* is a cross section through a passthrough conduit and an auxiliary element or locking element according to FIG. 5*a*.
Figure 5A:
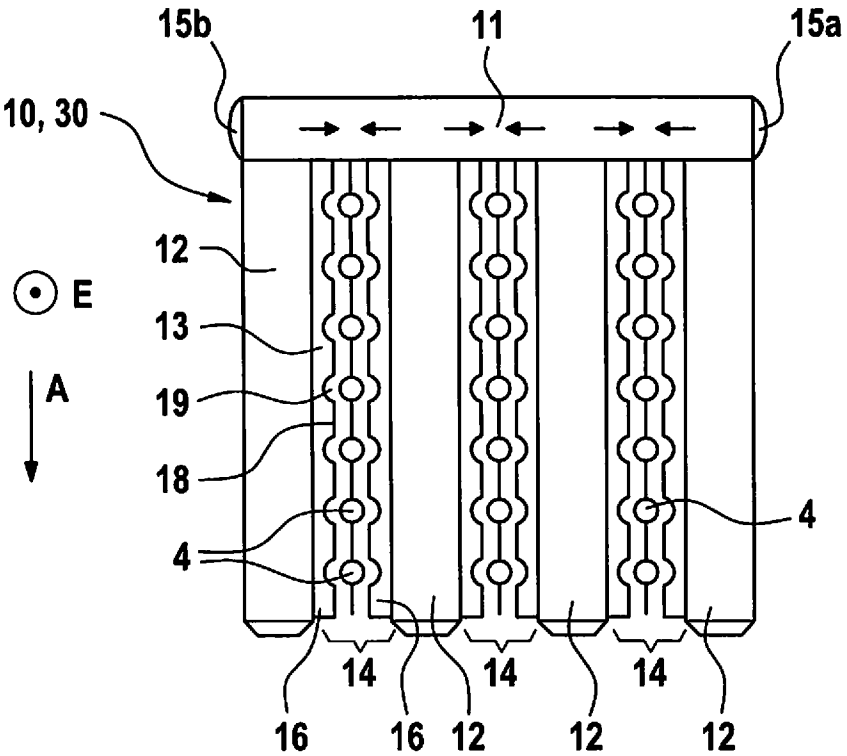
FIG. 5*a* is a plan view, from an insertion direction, of an auxiliary element or locking element, according to a further embodiment.

FIG. 5*a* depicts a further embodiment of locking element 30 or of auxiliary element 10. The perspective of FIG. 5*a* is, as in FIG. 3*a* and FIG. 4*a*, a plan view in extension direction E. Auxiliary element 10 or locking element 30 of FIG. 5*a* has, in addition to base element 11 and arms 12 extending in extension direction A, sealing lips 16 displaceable relative to arms 12. The relative displacement of sealing lips 16 occurs, for example, in a direction that is perpendicular to insertion direction E and perpendicular to extension direction A. Sealing lips 16 can have at their free end 18 a profile as in the exemplifying embodiments of FIGS. 4*a* and 4*b*. A linear or straight profile can also be provided, however, as in the embodiment according to FIGS. 3*a* and 3*b*. Sealing lips 16 are displaceable relative to the arms, and in a first position can thereby, for example, leave interstice 14 almost completely open. In this first position, auxiliary element 10 or locking element 30 can be slid particularly easily into opening 8 of contact carrier 2. Once auxiliary element 10 or locking element 30 has been completely slid in, sealing lips 16 can then be caused to be displaced toward the respectively associated interstice 14 (i.e., respectively from left to right and from right to left in the Figure), for example by a movement of a slider 15*a*, 15*b* disposed on base element 11. They can thereby close off interstice 14, or interstice 14 is thereby closed off and sealed with respect to the passage of fluid media, for example sealant 5. Sealing lips 16 are thus displaceable from a first position in which interstice 14 is relatively wide (e.g. more than 40% open) into a second position. In the second position, interstice 14 between adjacent arms is relatively completely closed, for example involving more than 80% or even more than 90% of the interstice area.

FIG. 5*b* depicts a cross section in insertion direction E, analogously to FIGS. 3*b* and 4*b*. Extension direction A is directed into the plane of the drawing. Locking element 30 or auxiliary element 10 is, for example, completely slid in. Sealing lips 16 are displaced from the first position into the second position (i.e. into interstices 14), and in that second position almost completely close off interstices 14 between adjacent arms 12. Sealing lips 16 surround electrical leads 4, for example, elastically, in collar fashion, and tightly. The electrical leads are thereby sealed.

The proposed wiring harness plug connector can be utilized, for example, in the automotive sector for multiple-pole wiring harness plug connectors or plug connectors. Utilization in a single-pole plug connector system is also possible, however.

What is claimed is:

1. An auxiliary element for insertion into a wiring harness plug connector and suitable for preventing the removal of a contact element that is connected to an electrical lead and is slid into the wiring harness plug connector, the auxiliary element having a base element and at least two self-supporting arms spaced apart from one another and protruding transversely from the base element, the at least two arms each having at least one sealing lip, the sealing lips of adjacent arms facing toward one another and being configured in such a way that an interstice between adjacent arms is at least 80% closed.

2. A wiring harness plug connector, comprising:

a contact carrier;

at least one electrical lead, the contact carrier having at least one passthrough conduit for the at least one electrical lead, the at least one electrical lead being passed through the passthrough conduit in an insertion direction, the contact carrier having, in front of the at least one passthrough conduit when viewed in the insertion direction, a partition that surrounds a sealing space, wherein the sealing space is filled with a sealant in such a way, and the sealant at least locally fills up the at least one passthrough conduit in such a way, that the at least one electrical lead is surrounded in fluid-tight fashion; and a locking element that is slidable into the wiring harness plug connector transversely to the insertion direction, the locking element being embodied in such a way that in the slid-in state it prevents a contact element, connected to the at least one electrical lead, from being removed from the contact carrier oppositely to the insertion direction, the locking element having a base element and at least two self-supporting arms spaced apart from one another and protruding transversely from the base element, the at least two arms each having at least one sealing lip, the sealing lips of adjacent arms facing toward one another and being configured in such a way that an interstice between the adjacent arms is at least 80% closed.

3. The wiring harness plug connector as recited in claim 2, wherein the sealant is constituted from a material that is liquid in a first state and can be converted permanently into a second, non-fluid state in such a way that in the second state it can no longer flow into the at least one passthrough conduit.

4. The wiring harness plug connector as recited in claim 2, wherein the sealant is made of an elastomer.

5. The wiring harness plug connector as recited in claim 2, wherein the sealing space is contiguous with an external environment of the wiring harness plug connector.

6. The wiring harness plug connected as recited in claim 2, wherein the interstice is at least 90% closed.

7. The wiring harness plug connector as recited in claim 2, wherein the at least one sealing lip has a profile along its self-supporting end that faces away from the arm, the profile being embodied complementarily to an outer contour of the at least one electrical lead that is surrounded by the sealing lip when the locking element is in an inserted state.

8. The wiring harness plug connector as recited in claim 2, wherein the at least one sealing lip is fastened on the arm displaceably, transversely to the extension direction of the arm, with respect to the associated arm.

9. A method for manufacturing a fluid-tight wiring harness plug connector, the wiring harness plug connector having a contact carrier, the contact carrier having at least one passthrough conduit for passage of at least one electrical lead, the contact carrier having, in front of the at least one passthrough conduit when viewed in an insertion direction, a partition that surrounds a sealing space, the method comprising:

furnishing the contact carrier;

introducing at least one electrical lead, in the insertion direction, through the sealing space and through the at least passthrough conduit;

introducing an auxiliary element into the wiring harness plug connector, the auxiliary element sealing the at least one passthrough conduit at least locally in such a way that penetration of a liquid sealant from the passthrough conduit into portions downstream from the auxiliary element is prevented;

introducing a liquid sealant into the sealing space; and curing the sealant.

10. The method as recited in claim 9, wherein the auxiliary element has a base element and at least two self-supporting arms spaced apart from one another and protruding transversely from the base element, the at least two arms each having at least one sealing lip, the sealing lips of adjacent arms facing toward one another and being configured in such a way that an interstice between the adjacent arms is at least 80% closed.

11. The method as recited in claim 10, wherein the interstice is at least 90% closed.

12. The method as recited in claim 9, wherein the auxiliary element is removed from the wiring harness plug connector after the step of curing the sealant, a locking element then being inserted into the wiring harness plug connector, the locking element being embodied in such a way that in the slid-in state it prevents the removal, oppositely to the insertion direction, of a contact element connected to the at least one electrical lead.

13. The method as recited in claim 9, wherein the auxiliary element acts as a locking element and is embodied in such a way that in the slid-in state it prevents the removal, oppositely to the insertion direction, of a contact element connected to the at least one electrical lead.

14. The auxiliary element as recited in claim 1, wherein the interstice is at least 90% closed.

* * * * *